US005514249A

United States Patent [19]

Cauley et al.

[11] Patent Number: 5,514,249

[45] Date of Patent: May 7, 1996

[54] PRODUCTION OF PAPER

[75] Inventors: Thomas A. Cauley, Ontario, Canada; John G. Langley; Adrian Nixon, both of West Yorkshire, England

[73] Assignee: Allied Colloids Limited, West Yorkshire, England

[21] Appl. No.: 268,128

[22] Filed: Jul. 6, 1994

[30] Foreign Application Priority Data

Jul. 6, 1993 [GB] United Kingdom ..... 9313956

[51] Int. Cl.[6] ..... D21H 21/10

[52] U.S. Cl. ..... 162/164.1; 162/164.3; 162/168.1; 162/168.2; 162/168.3; 162/181.6; 162/181.8; 162/183

[58] Field of Search ..... 162/168.2, 168.1, 162/183, 181.6, 181.8, 164.3, 164.6, 164.1

[56] References Cited

U.S. PATENT DOCUMENTS

| | | | |
|---|---|---|---|
| 3,052,595 | 9/1962 | Pye | 162/164 |
| 4,305,781 | 12/1981 | Langley et al. | 162/164 R |
| 4,388,150 | 6/1983 | Sunden et al. | 162/175 |
| 4,643,801 | 2/1987 | Johnson | 162/164.1 |
| 4,749,444 | 6/1988 | Lorz et al. | 162/168.3 |
| 4,753,710 | 6/1988 | Langley et al. | 162/164.3 |
| 4,795,531 | 1/1989 | Sofia et al. | 162/164.6 |
| 4,913,775 | 4/1990 | Langley et al. | 162/164.3 |
| 5,032,227 | 7/1991 | Derrick et al. | 162/168.1 |
| 5,234,548 | 8/1993 | Hatton | 162/168.3 |

*Primary Examiner*—Peter Chin

*Attorney, Agent, or Firm*—Sughrue, Mion, Zinn, Macpeak & Seas

[57] ABSTRACT

Paper is made by adding nonionic or anionic polymeric retention aid to a suspension that contains a high electrolyte content, shearing the flocculated suspension, aggregating the sheared suspension by adding anionic particulate material (especially bentonite), and draining the suspension.

18 Claims, 1 Drawing Sheet

PRODUCTION OF PAPER

FIELD OF THE INVENTION

This invention relates to the production of paper (including paper-board) by processes in which a cellulosic suspension is drained through a screen to form a sheet, which is then dried.

BACKGROUND OF THE INVENTION

It is well known to add high molecular weight polymeric retention aid to the cellulosic suspension during the papermaking process. Usually the retention aid is added after the last point of high shear, generally immediately prior to drainage. It is also known to include particulate inorganic material such as bentonite, for instance it may be added to thick stock to reduce pitch problems.

There have been a few instances where it has been proposed to use a substantially non-ionic retention aid, but more usually the retention aid is ionic, most usually cationic.

U.S. Pat. No. 3,052,595 discloses a method of making paper comprising the addition of filler, bentonite and non-ionic acrylamide to the cellulosic suspension. It is disclosed that the polymer can be added to the suspension either before or after the addition of fillers, but the preferred process involves adding bentonite to a cellulosic suspension containing filler, and then adding the polymer. The disclosure is concerned with conventional suspensions and the production of filled, good quality, paper, and the discovery that the inclusion of bentonite with the filler enhances the activity of a non-ionic polymeric retention aid.

U.S. Pat. No. 4,305,781 discloses a method of making paper from a pulp having a high cationic demand by adding bentonite to the stock followed by a substantially non-ionic polyacrylamide as a retention aid. Bentonite is added so as to modify the suspension to render it amenable to treatment by the substantially non-ionic retention aid. In U.S. Pat. No. 4,749,444, a low molecular weight cationic polymer is added after the bentonite and before the non-ionic retention aid, so as to modify the formation properties of the paper.

In U.S. Pat. No. 4,643,801, cationic starch is mixed into the suspension and thereafter an electro-neutralising amount of anionic polymer and dispersed silica are added, generally as a mixture, but it is also mentioned that the anionic polymer may be added followed by the dispersed silica.

In U.S. Pat. No. 4,795,531 low molecular weight cationic polymer is added to the cellulosic suspension to neutralise the charge in the suspension, and subsequently high molecular weight polymer and colloidal silica are added in either order. The high molecular weight polymer can be anionic or cationic.

Despite some usage of non-ionic or anionic retention aids, as indicated above, it is more common to use cationic retention aids. The amount of cationic retention aid that is required generally increases with increasing anionic charge in the suspension.

The cationic polymer that is to be used as a retention aid is normally added after the last point of high shear, but in U.S. Pat. Nos. 4,753,710 and 4,913,775 we describe processes in which a cationic polymer is added, the suspension is then subjected to shearing, and bentonite is then added prior to drainage. It is explained that microflocs are formed by the shearing and that the amount of cationic polymer should be sufficient to render parts at least of the surfaces of the microflocs sufficiently cationically charged, but it is acknowledged that the Zeta potential of the stock prior to addition of the bentonite can be either cationic or anionic. It is stated to be essential to use a cationic polymer rather than a non-ionic or anionic polymer. It is stated that the flocs carry sufficient cationic charge to interact with the bentonite.

These processes have been commercialised very successfully under the trade name "Hydrocol" and they are effective for a wide range of cellulosic suspensions. It is explained in U.S. Pat. No. 4,753,710 that the retention aid should be cationic and is a fact that other retention aids are generally unsatisfactory in that process.

It is alleged in U.S. Pat. No. 5,234,548 (not published until after the priority date of this application) that good results are obtained when the retention aid is an anionic or nonionic polymer but the only detailed proposal for when this might apply is when the suspension is initially dosed with a cationic donor such as alum or a low molecular weight cationic polymer.

The reality is that conventional suspensions can advantageously be dosed with low molecular weight cationic polymer and still be suitably treated with cationic high molecular polymer in the process of U.S. Pat. No. 4,753,710. However the use of cationic retention aid followed by bentonite, as in the Hydrocol process, does prove less satisfactory with some suspensions, and in particular with those have a substantial amount of electrolyte in them, which may arise from the presence of anionic trash, recycling or added materials. Thus, for instance, the processes have been less successful for the treatment of mechanical pulps such as groundwood and thermo-mechanical pulps; dirty pulps such as crude pulps traditionally used for newsprint manufacture; and recycled pulps such as de-inked waste; and for the treatment of suspensions in closed mills wherein the whitewater is repeatedly recycled with the introduction of only low amounts of fresh water into the process. The anionic trash arises from impurities in the mechanical pulps. The high electrolyte content may alternatively arise from, for instance, the use of filler that is liable to render the white water alkaline due to partial dissolution of the filler, for instance calcium sulphate or calcium carbonate.

Suspensions which contain high electrolyte levels are generally anionic and conventional thinking would suggest that increased amounts of cationic polymer should be added to reduce or eliminate the anionic nature of the suspension.

Processes involving the application of cationic starch and colloidal silicic acid or other modified silicas are described in U.S. Pat. No. 4,388,150 and have been commercialised under the trade name "Composil". In general, these processes are applicable to a narrower range of suspensions than the "Hydrocol" process.

It would be desirable to be able to devise a dewatering process for the manufacture of paper that can have, in particular, good dewatering performance (retention, drainage and/or drying) and formation properties as good as the "Hydrocol" process, using a pulp having a high electrolyte content rather than a conventional pulp that typically works with the "Hydrocol" process using cationic retention aid. In particular, it would be desirable to be able to obtain benefits similar to those of the "Hydrocol" process in a cost-effective manner when treating a cellulosic suspension that contains significant amounts of anionic trash.

SUMMARY OF THE INVENTION

According to the present invention a process for making paper (including paper-board) is provided, the process comprising the steps of forming an aqueous cellulosic suspension, adding to the suspension a polymeric retention aid having an IV of at least 6 dl/g to form flocs, shearing the suspension to break down the flocs to form microflocs, aggregating the microflocs by adding to the suspension an anionic particulate material, and draining the suspension to form a sheet and white water which drains through the screen and drying the sheet, wherein the polymeric retention aid is a substantially non-ionic or anionic polymer formed of non-ionic monomer units and less than 2 mole percent cationic units or less than 30 mole (preferably 10 mole) percent anionic units, and the suspension to which the retention aid is added is a suspension that contains a high electrolyte content. The high electrolyte content is manifested by high conductivity. The polymers are formed from ethylenically unsaturated monomers. Anionic monomer provided anionic units, cationic monomer provides cationic units and nonionic monomer provides nonionic units.

In other processes of the invention the same process is applied but the suspension, instead of containing high electrolyte, has been treated with an excess of cationic starch or low molecular weight cationic polymer, so that it has a near zero or positive zeta potential before addition of the retention aid.

DETAILED DESCRIPTION OF THE INVENTION

Figure 1:
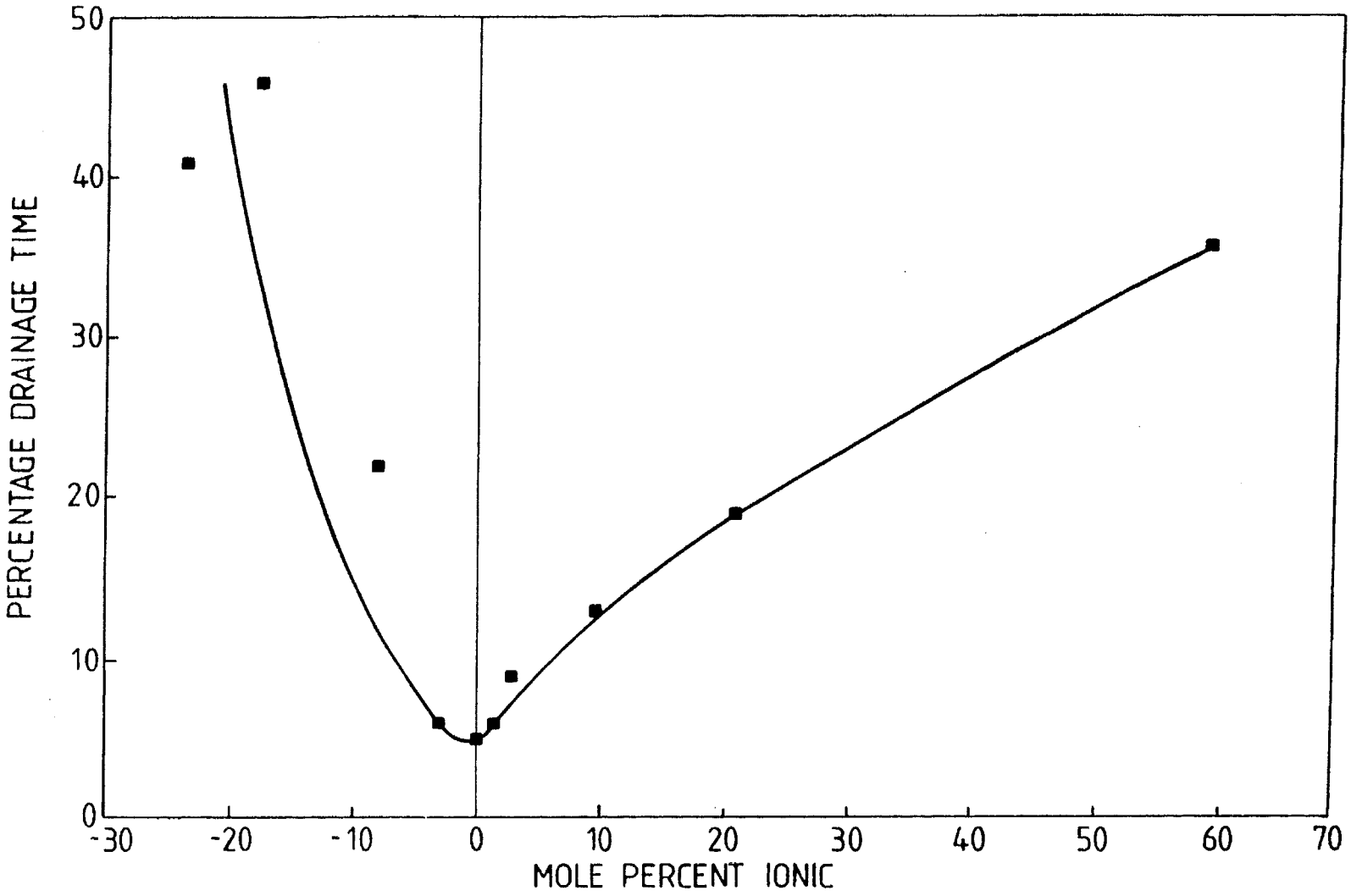
FIG. 1 is a graph of percentage drainage time (% seconds vs ionic content (mole %)).

In the invention we surprisingly find that good results can be obtained using a substantially nonionic or anionic polymeric retention aid when the suspension, at the time of the addition of that retention aid, has a high amount of electrolyte. If the overall process of the invention involves adding, for instance, a cationic polymer before the defined nonionic or anionic polymeric retention aid, then the suitability of the nonionic or anionic polymeric retention aid will be dependent upon the properties of the suspension after the addition of the cationic polymer and so the polymer must be selected having regard to the properties of the suspension containing that polymer.

The amount of electrolyte and the other properties of the suspension are generally such that, after treatment with the said retention aid at a dose of 400 grams per tonne dry weight, the suspension gives a Schopper Riegler drainage time that is shorter than the drainage time obtained when the same suspension is treated with the same dosage of each of cationic and anionic test retention aids of substantially the same IV as the substantially non-ionic retention aid, wherein the cationic test retention aid contains 5 mole percent cationic units and the anionic test retention aid contains up to 25 mole percent (usually 15 mole percent) anionic units.

The invention includes processes in which the choice of polymeric retention aid is made, at least in part, on the basis of conducting a test as described.

The amounts of retention aid and particulate material must of course be such that useful results are obtained. For instance processes that use so little bentonite (or other anionic particulate material) that poor retention is obtained are unsatisfactory. The amount of bentonite should usually be about (e.g., within 25% or 50%) of the amount that gives optimum retention.

The Schopper Riegler drain test which, if desired, can be used in the invention is conducted by mixing the chosen amount of the dissolved polymer dissolved in water with 500 ml of the cellulose suspension in a measuring cylinder filled with the suspension, inverting the cylinder four times to cause flocculation, transferring the flocculated suspension to a Schopper Riegler beating and freeness tester modified by blockage of its back drain, and measuring the time for collecting 230 ml of drain liquor, and expressing this time as a percentage of the drainage time in the absence of the polymer addition.

The cationic test retention aids that are used are copolymers of acrylamide and dimethylaminoethyl quaternary salt while the anionic test retention aids are copolymers of acrylamide and sodium acrylate.

The Schopper Riegler drainage test is conducted on the suspension to which the substantially non-ionic retention aid or the anionic retention aid is to be added or on a suspension substantially the same as that suspension. Accordingly the retention aid may be selected on the basis of tests conducted on the actual suspension or on the basis of tests conducted on a sample suspension made up in the laboratory from ingredients that will simulate the actual suspension, for instance after prolonged recycling. If the properties of the suspension change during prolonged use, fresh tests may be required to select the polymer that is then necessary. If a chemical pre-treatment of the suspension is to be made (for instance the addition of a low molecular weight cationic polymer) before the addition of the substantially non-ionic polymer, the Schopper Riegler test is conducted on the suspension after such chemical treatment.

The test can be conducted on various suspensions using polymers of various types ranging from anionic through substantially non-ionic to cationic. When the results for any individual suspension are plotted with the drainage time on the vertical axis against the ionic characteristics of the polymer on the horizontal axis for any particular suspension the curve generally follows an approximately V-shape or U-shape. The bottom of the curve indicates the ionic characteristic of the polymer at which the fastest drainage occurs. The position of this varies from one suspension to another. We find that with most paper-making pulps the optimum value is in the cationic range, but that with pulps containing a substantial amount of electrolyte the optimum performance is in the range of substantially non-ionic or anionic polymers.

The electrolyte in the suspension can be of organic origin and so can be anionic trash from the original cellulosic pulp or recycled cellulosic suspension. Alternatively or additionally it can be of inorganic origin and so it can be due to partial dissolution of an alkaline filler such as calcium sulphate or carbonate, or the hardness of the water. Electrolyte can be added deliberately.

By referring to a suspension having a high electrolyte content we mean that the white water has high conducitivty. The invention is of particular value when the conductivity of the white water is above 1500 microsiemens, often 2000–3000 microsiemens or more. The conductivity can be measured by conventional techniques.

The suspension will often contain a high amount of anionic trash if it is to be treated usefully in the invention and so may have been formed from crude pulp. Thus the cellulosic component of the suspension may contain a significant amount of a mechanical pulp (such as ground wood) and/or a thermo-mechanical pulp and/or a de-inked waste. Preferably the total amount of mechanical pulp and/or thermo-mechanical pulp and/or de-inked waste is at least 50% and generally at least 80% and preferably substantially the entire amount of the cellulosic material in the suspension.

The electrolyte content can, alternatively or additionally, arise from alkaline filler, especially calcium sulphate, that dissolves slightly into the suspension. Accordingly other suspensions to which the invention is usually applied are suspensions that contain at least 5%, and generally 10–50% (based on the dry solids content of the suspension) of calcium sulphate or other very slightly soluble alkaline filler.

The invention is of particular value when using such cellulosic material and/or filler in a closed mill in which white water from the drainage stage is repeatedly recycled for diluting thick stock to make the thin stock suspension that is treated with the retention aid and subsequently drained, to form paper such as newsprint. Prolonged recycling of the white water, as a result of the mill being substantially entirely closed, can cause accumulation of electrolyte and therefore high conductivity. When there is very little recycling of white water, a mill may typically require 100 tons water or more to make a ton of paper. When there is very extensive recycling, a mill may only require 5–10% tons water per ton paper. The invention is preferably applied to mills where there is extensive recycling, e.g., 50 that the mill uses less than 30, preferably less than 20 and most preferably 2–15 tons freshly introduced water per ton of paper produced.

The invention is also of value when electrolyte is deliberately added to the suspension, which may be subjected to prolonged recycling. For instance sodium chloride or other monovalent metal salt (or any other water soluble electrolyte) can be added to a suspension or thick stock to provide a conductivity value such that the anionic or nonionic retention aid is then suitable. For instance sodium chloride may be added when the pulp is a dirty pulp having high cationic demand, thereby suppressing the cationic demand (as measured by titration against a cationic polymer) and making it suitable for use in the invention.

Another instance when the invention is of particular value is in the production of liner board from a suspension that has been treated with large amounts of alum.

The invention is also of value when the suspension, regardless of anionic trash or other electrolyte content, has been pre-treated with low molecular weight (intrinsic viscosity below 3 dl/g) cationic polymer and/or cationic starch in an amount sufficient to give a near zero, or positive zeta potential. Suitable low molecular weight polymers are described in U.S. Pat. No. 4,913,775. Alum or other inorganic coagulant can be used in place of part or all of the cationic polymer.

The suspensions to which the invention is applicable include those where the optimum performance (i.e., shortest drain time) is obtained with a polymer falling within the range 25, preferably 20 or 15, mole percent anionic groups to 5 mole percent cationic groups. Preferably the minimum is obtained at less than 2 mole percent cationic groups, and preferably the minimum is obtained with less than 10 mole percent, and most preferably less than 6 mole percent, anionic groups. These values all assume that there is no deliberate intention to produce an amphoteric polymer. If the polymer is amphoteric then an appropriate adjustment in the quantitative amounts of the anionic and cationic groups may be appropriate. For instance similar performance may be obtained from a polymer made by charging 2 mole percent cationic monomer and 98% acrylamide as would be obtained from charging 7 mole percent cationic monomer, 5 mole percent anionic monomer and 88 mole percent acrylamide.

It is often preferred that the retention aid that is used in the process of the invention should be the one that gives optimum performance in the described Schopper Riegler drain test. However economic or other considerations sometimes make it preferable to use a slightly different polymer. Generally the polymer that is actually used contains from −2 mole percent to +1 mole percent of the ionic content of the optimum polymer, that is to say if the optimum polymer is wholly non-ionic the used polymer contains from 2 mole percent anionic groups to 1 mole percent cationic group, and if the optimum polymer contains 2 mole percent anionic groups then the polymer that is used contains from 4 to 1 mole percent anionic groups.

An additional or alternative way of defining a suitable suspension is by determining the drainage time of it or of a substantially similar suspension as described above when using 400 g/t of a standard substantially non-ionic test retention aid consisting of a non-ionic polyacrylamide having intrinsic viscosity 13 to 16 dl/g and formed from about 99 to 100% acrylamide and about 0 to 1% sodium acrylate (on a molar basis). The drainage time with such a polymer should be below 50%, preferably below 30% and most preferably below 15% of the drainage time of the suspension without the addition of the polymer.

Instead of or in addition to meeting this criterion, the drainage time with the non-ionic test retention aid may be below 80% and preferably below 50% of the drainage time obtained with the 15 mole percent anionic test retention aid and below 90%, and preferably below 70% of the drainage time obtained with the 5 mole percent cationic test retention aid.

As a generality the suspension can be substantially unfilled, for instance containing no filler other than filler that may be recycled in the white water, or it may be filled as a result of deliberate filler addition. Often relatively crude pulps are used in which event the amount of filler in the suspension is generally low, for instance in the range 0 to 20 or 30% by weight based on dry solids, and the amount of filler in the resultant paper is generally in the range 0 to 15%, often around 5 to 10%, by weight of the paper.

When filler is used it can be any conventional papermaking filler but, as mentioned above, the invention is of particular value when the filler is an alkaline filler having some solubility, sufficient to build up alkalinity in the white water during prolonged recycling. Such a filler is calcium sulphate or carbonate.

In conventional processes the interaction between the retention aid and the solids (fibre and filler) is often essentially counter-ionic. Thus a cationic retention aid is appropriate with conventional anionic fibre and filler particles and an anionic retention aid is appropriate when the fibre and filler particles have been overdosed with cationic donor, as in U.S. Pat. Nos. 5,234,548, 4,643,801 or 4,795,531. However in the high electrolyte, high conductivity suspensions of the invention, this electrostatic interaction mechanism probably does not apply and instead we believe that hydrogen bonding is the main mechanism for interaction of the polymeric retention aid with the cellulosic fibres and filler particles if present, and between the microflocs and the anionic particulate material. The hydrogen bonding capability of the nonionic or anionic polymer is unaffected by the electrolyte content in the suspension whereas the electrostatic bonding capability of cationic retention aid is neutralised or rendered relatively ineffective by the anionic and electrolyte content of the suspension.

When the retention aid polymer is wholly non-ionic (i.e., when no deliberate addition of anionic or cationic groups has been made) the polymer is preferably polyethylene oxide or polyacrylamide formed from acrylamide without any deliberate addition of anionic monomer. However acrylamide is frequently contaminated with a small amount of anionic monomer and so this polyacrylamide may be found to be formed from up to about 1 mole percent (typically 1.5 mole percent maximum) sodium acrylate, with the remainder being acrylamide.

However it is not essential in the invention to use a wholly non-ionic polymer as the retention aid. Substantially non-ionic polymers used in the invention are preferably copolymers of acrylamide (or other non-ionic ethylenically unsaturated monomer that does not render the polymer insoluble in water) with less than 2 (and usually not more than 1 or 1.5) mole percent cationic monomer and/or up to 10 (and usually not more than 5, and usually not more than 3) mole percent anionic monomer. However, in some instances best results are obtained with polymers having a higher anionic content, for instance up to 20 mole percent or even 30 mole percent anionic monomer.

Suitable cationic monomers include nitrogen-containing ethylenically unsaturated monomers, such as dialkylaminoalkyl-(meth)acrylamides and -(meth)acrylates, usually as their acid salts or quaternary derivatives. Suitable anionic monomers include ethylenically unsaturated carboxylic or sulfonic acids, which may be present as the free acid or as the water soluble salt, for instance with ammonium or sodium or other alkali metal. The preferred monomers include sodium acrylate as the anionic monomer and dimethylaminoethyl acrylate quaternary salt as the cationic monomer.

Useful results can be obtained in the invention, on appropriate suspensions, with deliberately anionic polymers, especially in the production of liner board and with high conductivity white water process and with low amounts of fresh water. However the invention is of particular value on suspensions where the polymeric retention aid is what we consider to be a "substantially nonionic polymer", that is to say a polymer formed of nonionic monomer units optionally with less than 2 mole percent cationic units and/or less than 10 mole percent anionic units.

The retention aid and test polymers generally have an intrinsic viscosity above 6 dl/g and preferably above 8 dl/g. It can be up to for instance 18 dl/g or higher. Often it is in the range 13 to 16 dl/g but when making cationic test polymers at higher cationic contents it may be suitable to use test polymers having IV values in the range, for instance, 6 to 10 dl/g even though the retention aid may have higher IV. Intrinsic viscosity values quoted herein are measured by a suspended level viscometer at 25° in buffered 1% sodium chloride solution.

The anionic particulate material can be any material that has a sufficiently large and sufficiently hydrophilic surface area to permit appropriate aggregation of the microflocs. Preferably the material has a surface area of at least 200 to 800 square meters per gram. The material can be colloidal silicic acid or derivatives thereof (for instance as described in U.S. Pat. No. 4,388,150) or it can be an emulsion (preferably a micro-emulsion) of an anionic hydrophilic polymer in water, or zeolite or a silica gel material as in U.S. Pat. No. 4,927,498. Preferably it is an anionic swelling clay as described in U.S. Pat. No. 4,753,710. Suitable swelling clays are generally classed as bentonite but this term embraces smectites and include hectorites and montmorillonites.

The amount of the substantially non-ionic retention aid that is added will be selected having regard to the particular suspension that is being treated, and will be influenced by whether or not the suspension has already been treated by the addition of other polymeric material. Routine tests, such as the Schopper Riegler test, can be used to determine a suitable amount, which is usually about the optimum amount. This is generally in the range 100 to 2,000 g/t (grams per ton dry weight of the suspension), preferably in the range 300 to 1,000 g/t.

Routine testing establishes the amount that is optimum for a particular process (i.e., with a predetermined amount of polymer), and this is the preferred amount. However greater or lesser amounts (e.g., ±50% and preferably ±25%) of this amount can be used.

When performance is determined over a range of polymer dosages (at constant particulate dosage), it will generally be found that performance increases with increasing dosage to a maximum, but that further increase in dosage results in no further increase or in deterioration, in properties. If insufficient polymer is used poor drainage and/or retention properties will be obtained either because the microflocs are so unstable that they break down to the component fibres and filler particles or because there is insufficient aggregation of the microflocs by the anionic particulate material. Preferably the amount of polymer is such that the initial flocs are easily broken down to microflocs by the shearing, but that the microflocs are less easily degraded by continuation of the shearing.

The shearing may be provided merely by turbulent flow of the flocculated suspension along a duct to the point at which the anionic particulate material is applied, or the shearing may be provided by a highs hear process step such as passage through a pump (e.g., a fan pump) or a screening device such as a centriscreen. The non-ionic polymeric material may be added at a single point of addition or at two or more points of addition, for instance with each addition point being followed by a shearing stage.

The bentonite or other anionic particulate material is usually added in an amount of 300 to 10,000 g/t, often around 1,000 to 3,000 g/t. However when the anionic material is less efficient as an aggregating aid than bentonite, larger amounts may be useful, for instance up to 20,000 g/t.

The anionic particulate material is usually added after the last point of high shear, e.g., at the headbox, but it can be added at an earlier stage If desired.

The following are examples.

EXAMPLE 1

This is a laboratory test conducted using a modified Britt Jar and a modified Canadian Standard Freeness tester (CSF). Thus a standard, baffled Britt Dynamic Drainage Jar is modified by removing the wire and support mesh, and replacing these with a solid plastic disc. This creates a baffled stirring pot.

A CSF teeter is modified by blocking its back drain, and a measuring cylinder is placed under its front drain to create a drainage tester.

A 500 ml sample of a thinstock comprising a thermomechanical pulp furnish obtained from a newsprint machine and having a consistency of 0.95% (by weight dry solids in aqueous medium) is added to the modified Britt Jar. The sample is stirred at 1,500 rpm for 5 seconds. A sample polymer is then added, as a solution, at a dosage level of 0.8 g/t. The treated sample is stirred at 1,500 rpm for 1 minute, and is then transferred to a 500 ml measuring cylinder. Bentonite is added to the sample at a dosage level of 6 kg/t. The open end of the cylinder is then sealed and its contents mixed by inverting the cylinder four times.

The sample is then transferred to the modified CSF tester, and the drainage time measured by recording the time taken for 200 ml of backwater to drain from the 500 ml sample and collect in the measuring cylinder under the front drain of the CSF tester.

A blank test is performed according to the above procedure in the absence of both added polymer and added bentonite. The drainage time recorded for each of the polymer samples are then normalised by expressing them as a percentage of the blank drainage time.

The dosage levels of the polymer and the bentonite are expressed in terms of kg/t which is kg of dry polymer or bentonite per tonne of dry fibre.

The sample polymers are as follows:

| Sample Polymer Type | Ionic Content (sign and mole %) | Intrinsic Viscosity (dl/g) |
|---|---|---|
| ACM(NaAC | −23.6 | 17.0 |
| ACM/NaAC | −17.6 | 12.0 |
| ACM(NaAC | −7.9 | 12.0 |
| ACM/NaAC | −3.0 | 13.0 |
| ACM | 0 | 12.0 |
| ACM/DMAEAqMeCl | +1.4 | 11.0 |
| ACM/DMAEAqMeCl | +2.7 | 6.0 |
| ACM/DMAEAqMeCl | +9.7 | 8.0 |
| ACM/DMAEAqMeCl | +20.9 | 6.5 |
| ACM/DMAEAqMeCl | +59.5 | 7.0 |

Where ACM/NaAC is a copolymer of acrylamide and sodium acrylate, ACM is acrylamide homopolymer and ACM/DMAEAqMeCl is a copolymer of acrylamide and dimethylaminoethylacrylate quaternised with methyl chloride.

FIG. 1 is a graph of percentage drainage time (% seconds) vs ionic content (mole %), and shows the results obtained by use of the sample polymers in the above described test in the form of a relatively smooth curve.

The results illustrate that the optimum polymer has an ionic content of about 0% of those tested, this was represented by the acrylamide homopolymer.

Although the curve is relatively smooth, in practice there can be irregularities. It may sometimes be observed that the performance at exactly zero percent ionic content is slightly worse than the performance on either side. However this may be due to a difference in, for instance, the solubility or molecular weight of the non-ionic polymer compared to the slightly anionic or slightly cationic polymers with which it was compared. Accordingly when interpreting plots of the performance of different polymers it is desirable either to ensure that the polymers are directly comparable, as regards molecular weight and solubility, or to study the overall shape of the curve rather than to rely upon any particular individual point.

The following examples demonstrate processes broadly as described in U.S. Pat. No. 4,753,710 but with different polymers.

EXAMPLE 2

Test results from a Light Weight Coated furnish.

A comparison of polymers of the same molecular weight, (IV 7.0 dl/g) but differing cationic contents.

Constant additions for the tests: Polymer 800 g/T and Bentonite 2 kg/T.

| Polymer Ionic Content (mole %) | Total Retention (%) |
|---|---|
| 0 | 57.7 |
| 0.37 | 59.7 |
| 0.74 | 59.2 |
| 1.12 | 57.4 |
| 1.50 | 55.6 |
| 1.89 | 54.9 |
| 2.28 | 55.8 |
| 2.68 | 55.3 |
| 3.08 | 56.4 |

This shows best results are obtained at 0–1% cationic.

EXAMPLE 3

Test results from a saturating base kraft furnish.

A comparison of polymers of the same molecular weight, (IV 7.0 dl/g) but differing cationic contents.

Constant additions for the test: Polymer 800 g/T Bentonite 2 kg/T.

| Polymer Ionic content (mole %) | Total Retention (%) |
|---|---|
| 0 | 81.3 |
| +0.37 | 84.3 |
| +0.74 | 81.7 |
| +1.12 | 81.0 |
| +1.50 | 77.9 |
| +1.89 | 77.4 |
| +2.28 | 76.6 |
| +2.68 | 78.4 |
| +3.08 | 77.1 |

This again shows best results at 0–1% cationic.

EXAMPLE 4

Test results from a fine furnish.

A comparison of cationic and anionic polymers. Constant additions for the tests: Polymer 500 g/t Bentonite 2 kg/T.

| Polymer Ionic Content (mole %) | Percentage Drain Tine (% seconds) |
|---|---|
| +26.8 | 57 |
| −7.74 | 34 |
| −33.5 | 35 |

The fine furnish is a relatively pure suspension having low electrolyte content. This shows that, on such a suspension, better results are obtained using cationic retention aid than with the nonionic or anionic retention aids of the invention.

EXAMPLE 5

Paper is made by a process as described generally in Example 1 of U.S. Pat. No. 4,753,710 except that the drained white water has a conductivity of above 2000 microsiemens (as a result of having been formulated to represent white water obtained in a process that utilised 10 tons fresh water per ton paper) and the cationic retention aid is replaced by a copolymer of 95% acrylamide and 5% (molar) sodium acrylate having intrinsic viscosity above 8 dl/g.

EXAMPLE 5

A paper furnish having 20% CaSO4 filler is formed with a headbox consistency of 0.5%. A Britt Jar tester is used to determine retention. The total retention in the absence of polymer is 79.8% and the ash retention is 9.1%. 400 g/t of 90% acrylamide 10% sodium acrylate polymer IV 12 dl/g is added and gives total retention 89.4% and ash retention of 74.4%. The same system with subsequent addition of 4kg/t bentonite gives total retention 96.9% and ash retention 91.7%.

As indicated, the process of the invention is best performed using suspensions that give a white water conductivity above 1500 microsiemens, preferably above 2000 microsiemens. The suspension is preferably such that it would have these high conductivity values irrespective of whether or not cationic starch or low molecular weight synthetic cationic polymer (or even alum) has been added to the suspension.

We claim:

1. A process for making paper at a paper mill comprising continuously forming an aqueous anionic cellulosic suspension from cellulosic pulp, recycled white water and added water which is supplied to the mill, adding to the suspension a polymeric retention aid having an IV of at least 6 dl/g to form flocs, shearing the suspension to break down the flocs to form microflocs, aggregating the microflocs by adding to the suspension an anionic particulate material, draining the suspension to form a sheet and white water which drains through the screen, recycling the white water to form the suspension, drying the sheet, wherein the polymeric retention aid is a water soluble polymer selected from the group consisting of non-ionic polymers of non-ionic ethylenically unsaturated monomer, copolymers of non-ionic ethylenically unsaturated monomer with cationic ethylenically unsaturated monomer in an amount of less than 2 mole percent, copolymers of non-ionic ethylenically unsaturated monomer with anionic ethylenically unsaturated monomer in an amount of less than 10 mole percent, copolymers of non-ionic ethylenically unsaturated monomer with anionic ethylenically unsaturated monomer in an amount of less than 10 mole percent and cationic ethylenically unsaturated monomer in an amount of less than 2 mole percent, and polyethylene oxide, and the white water is anionic and has a conductivity of at least 1500 microsiemens, and the amount of added water supplied to the mill is less than 30 tons per ton dry weight of paper.

2. A process according to claim 1 in which the amount of added water supplied to the mill is 2 to 20 tons per ton dry weight of paper.

3. A process according to claim 1 in which the water soluble polymer is selected from non-ionic polymers of non-ionic ethylenically unsaturated monomer, copolymers of non-ionic ethylenically unsaturated monomer with cationic ethylenically unsaturated monomer in an amount of not more than 1.5 mole percent cationic monomer, copolymers of non-ionic ethylenically unsaturated monomer with anionic ethylenically unsaturated monomer in an amount of not more than 5 mole percent, copolymers of non-ionic ethylenically unsaturated monomer with anionic ethylenically unsaturated monomer in an amount of not more than 5 mole percent and cationic ethylenically unsaturated monomer in an amount of not more than 1.5 mole percent, and polyethylene oxide.

4. A process according to claim 3 in which anionic monomer is present in the polymer and the amount of anionic monomer is not more than 3%.

5. A process according to claim 1 in which the water soluble polymer is selected from non-ionic polyacrylamide, polymers of acrylamide with up to 5 mole percent sodium acrylate, polymers of acrylamide with up to 1.5 mole percent dialkylaminoalkyl-(meth) acrylamide or dialkylaminoalkyl-(meth)acrylate acid salt or quaternary salt, and copolymers of acrylamide with up to 5 mole percent sodium acrylate and up to 1.5 mole percent dialkylaminoalkyl(meth)acrylamide or dialkylaminoalkyl(meth)acrylate as an acid salt or quaternary salt.

6. A process according to claim 1 in which the anionic particulate material is selected from swelling clays, colloidal silicic acids, zeolite, silica gels, and anionic polymeric microemulsions.

7. A process according to claim 1 in which the anionic particulate material is an anionic swelling clay.

8. A process according to claim 1 in which the anionic particulate material is bentonite.

9. A process according to claim 1 in which the white water has a conductivity of above 2,000 microsiemens.

10. A process according to claim 1 in which at least 50% by weight of the cellulosic material in the suspension is formed from a pulp selected from the group consisting of mechanical pulps, thermomechanical pulps, deinked wastes and mixtures thereof.

11. A process according to claim 1 in which the suspension contains at least 5% by weight calcium sulphate or calcium carbonate filler.

12. A process according to claim 1 in which the suspension contains alum and the paper is liner board.

13. A process for making paper comprising continuously forming an aqueous anionic cellulosic suspension utilizing cellulosic pulp and recycled white water, adding to the suspension a polymeric retention aid having an IV of at least 6 dl/g to form flocs, shearing the suspension to break down the flocs to form microflocs, aggregating the microflocs by adding to the suspension an anionic particulate material, draining the suspension to form a sheet and white water which drains through the screen, recycling the white water to form the suspension, drying the sheet, wherein the polymeric retention aid is a water soluble polymer selected from the group consisting of non-ionic polymers of non-ionic ethylenically unsaturated monomer, copolymers of non-ionic ethylenically unsaturated monomer with cationic ethylenically unsaturated monomer in an amount of less than 2 mole percent, copolymers of non-ionic ethylenically unsaturated monomer with anionic ethylenically unsaturated monomer in an amount of less than 10 mole percent, copolymers of non-ionic ethylenically unsaturated monomer with anionic ethylenically unsaturated monomer in an amount of less than 10 mole percent and cationic ethylenically unsaturated monomer in an amount of less than 2 mole percent, and polyethylene oxide, and the white water is anionic and has a conductivity of at least 1500 microsiemens due to organic electrolyte from the pulp.

14. A process according to claim 13 in which the water soluble polymer is selected from non-ionic polymers of non-ionic ethylenically unsaturated monomer, copolymers of non-ionic ethylenically unsaturated monomer with cationic ethylenically unsaturated monomer in an amount of not more than 1.5 mole percent cationic monomer, copolymers of non-ionic ethylenically unsaturated monomer with anionic ethylenically unsaturated monomer in an amount of not more than 5 mole percent, copolymers of non-ionic ethylenically unsaturated monomer with anionic ethylenically unsaturated monomer in an amount of not more than 5 mole percent and cationic ethylenically unsaturated monomer in an amount of not more than 1.5 mole percent, and polyethylene oxide.

15. A process according to claim 13 in which anionic monomer is present in the polymer and the amount of anionic monomer is not more than 3%.

16. A process according to claim 13 in which the anionic particulate material is bentonite.

17. A process according to claim 13 in which the white water has a conductivity of above 2,000 microsiemens.

18. A process according to claim 13 in which at least 50% by weight of the cellulosic material in the suspension is formed from a pulp selected from the group consisting of mechanical pulps, thermomechanical pulps, deinked wastes and mixtures thereof.

* * * * *